United States Patent [19]

Scholz et al.

[11] 4,384,565

[45] May 24, 1983

[54] PREFABRICATED FIREPLACE AND THE INSTALLATION THEREOF

[75] Inventors: Ray J. Scholz, Los Altoa; William C. Southern, Los Gatos, both of Calif.

[73] Assignee: Sierra Precast, Inc., San Jose, Calif.

[21] Appl. No.: 877,088

[22] Filed: Feb. 13, 1978

[51] Int. Cl.[3] ..... F24B 1/18; E04G 2/00

[52] U.S. Cl. ..... 126/120; 52/745

[58] Field of Search ..... 126/120, 121, 122, 141, 126/142, 143, 62; 52/745, 218

[56] References Cited

U.S. PATENT DOCUMENTS

| | | | |
|---|---|---|---|
| 611,179 | 9/1898 | May | 126/120 |
| 820,178 | 5/1906 | Bender | 126/120 |
| 2,821,975 | 2/1958 | Thulman . | |
| 3,190,279 | 6/1965 | Davis | 126/120 |
| 3,301,249 | 1/1967 | Hendricks | 126/120 |
| 3,466,000 | 9/1969 | Southern et al. | 126/120 |
| 3,538,909 | 11/1970 | Migues . | |
| 3,690,076 | 9/1972 | Harris . | |
| 3,721,225 | 3/1973 | Tidwell | 126/120 |

FOREIGN PATENT DOCUMENTS

| | | | |
|---|---|---|---|
| 875001 | 8/1961 | United Kingdom | 126/120 |

*Primary Examiner*—Samuel Scott

*Attorney, Agent, or Firm*—Jack M. Wiseman

[57] ABSTRACT

A prefabricated fireplace is installed on a fireplace foundation by welding together a weld plate on the lowermost surface of the prefabricated fireplace and a weld plate on the uppermost surface of the fireplace foundation.

4 Claims, 3 Drawing Figures

Fig-1
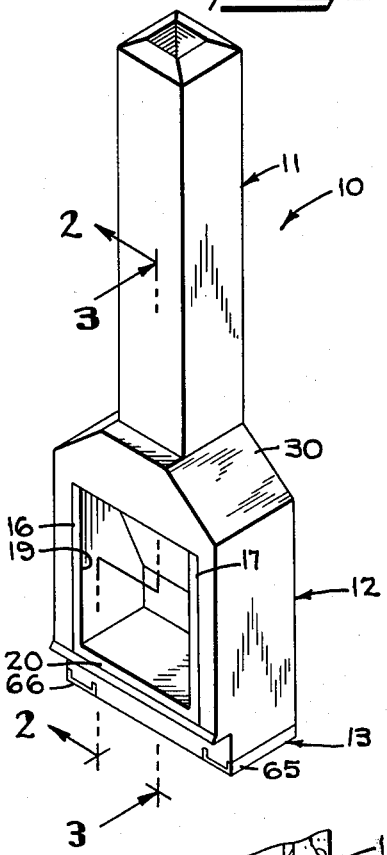
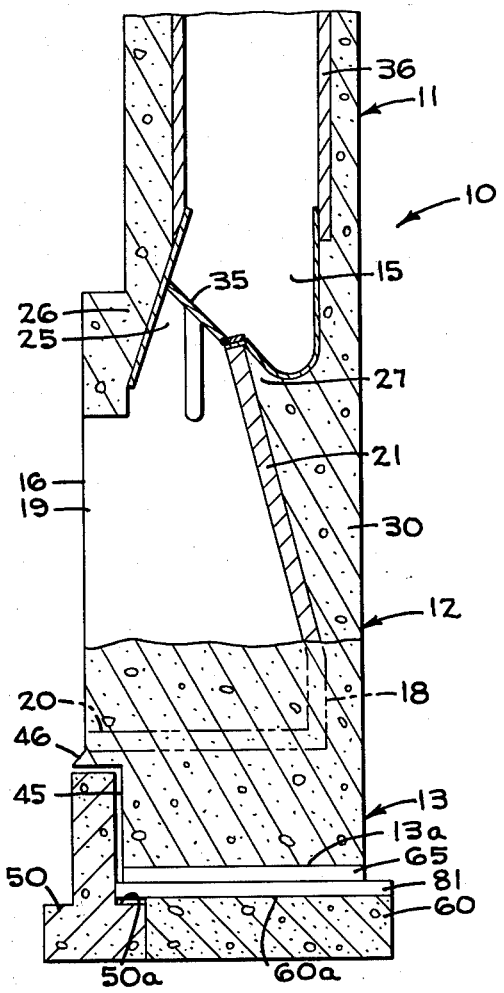
Fig-2
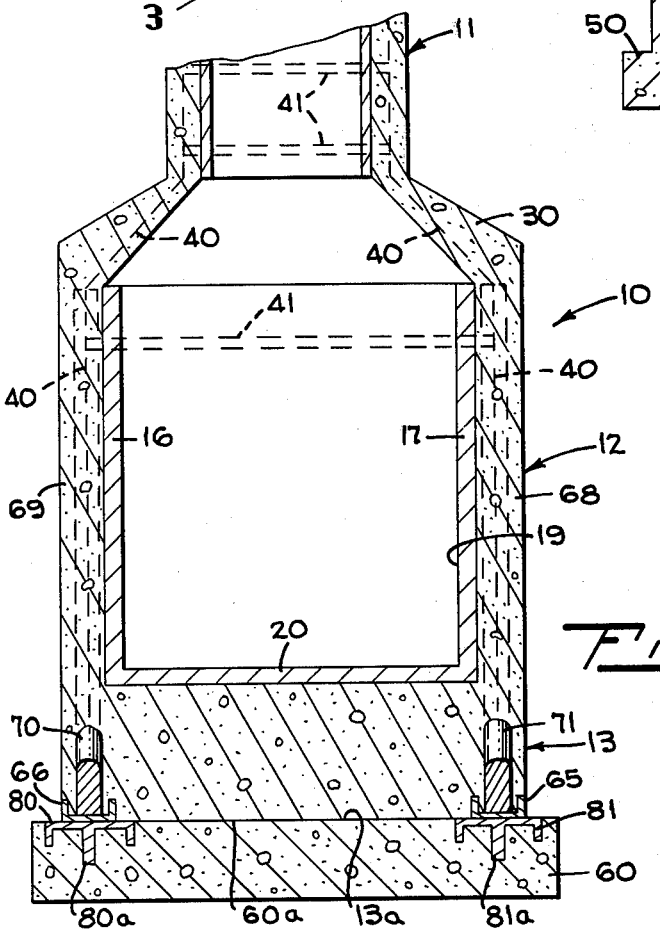
Fig-3

PREFABRICATED FIREPLACE AND THE INSTALLATION THEREOF

BACKGROUND OF THE INVENTION

The present invention relates in general to prefabricated fireplaces and more particularly to the installation of a prefabricated fireplace.

Prefabricated fireplaces have heretofore been installed on a house foundation. In order to do so, temporary braces were employed to hold the prefabricated fireplace in position until the prefabricated fireplace was completely installed and erected. The use of such temporary braces resulted in their being dislodged by construction equipment. Additionally, this arrangement had lent itself to bolt pull-outs. As a consequence thereof, there were occasions in which prefabricated fireplaces would fall over when the braces were so dislodged.

Prefabricated or precast fireplaces have been well-known in the art. In the patent to William C. Southern et al., U.S. Pat. No. 3,466,000, issued on Sept. 9, 1969, there is disclosed apparatus and method for forming a prefabricated or a precast fireplace. In the patent to Hendricks, U.S. Pat. No. 3,301,249, issued on Jan. 31, 1967, there is disclosed a precast fireplace, method of manufacture and erection. The precast fireplace disclosed by the patent to Hendricks rests the ledge thereof on a shoring which in the disclosed installation is the foundation of a house. An adjustable shoring brace is employed. The threaded end of the adjustable shoring brace is received by an internally threaded hole in the precast fireplace. The other end of the shoring brace is fixed to the house foundation.

The patent to Tidwell, U.S. Pat. No. 3,721,225, issued on Mar. 20, 1973, discloses a factory fabricated fireplace. A cement fireplace pad or footing is provided for the installation of the prefabricated fireplace. The prefabricated fireplace is disposed on the concrete pad or footing. Reinforcing rods are anchored at their lower ends in the concrete footing and project upwardly into the prefabricated fireplace for reinforcing the fireplace structure after it is assembled.

In the patent to Thulman, U.S. Pat. No. 2,821,975, issued on Feb. 4, 1958, there is disclosed a fireplace construction installed on a steel base plate. The fireplace is supported on the base plate, which may be a sheet of steel. Supporting legs may be spot welded to the bottom surface of the base plate to support the weight of the fireplace.

Other patents of interest are:

May, U.S. Pat. No. 611,179

Bender, U.S. Pat. No. 820,173

Migues et al., U.S. Pat. No. 3,538,909

The last-mentioned patents show fireplaces disposed upon their own foundations.

SUMMARY OF THE INVENTION

A prefabricated fireplace is installed on a fireplace foundation through the welding of a base plate on the prefabricated fireplace to a top plate on the fireplace foundation.

The base plate is in the form of a weld plate and the top plate is in the form of a weld plate. After placing the prefabricated fireplace on the fireplace foundation, the base plate and top plate are welded together.

By virtue of the present invention, the use of temporary braces has been obviated. Thus, dislodgement of temporary braces and bolt pull-outs by construction equipment have been avoided. The number of damaged precast fireplaces resulting from falling over without the presence of braces should be reduced.

DESCRIPTION OF THE DRAWINGS

FIG. 1 is a perspective view of a prefabricated fireplace adaptable for installation in accordance with the present invention.

FIG. 2 is a fragmentary vertical section view of the prefabricated fireplace shown in FIG. 1 taken along line 2—2 of FIG. 1 and installed in accordance with the present invention.

FIG. 3 is a fragmentary vertical section view of the prefabricated fireplace shown in FIG. 2 taken along line 3—3 of FIG. 1 and installed in accordance with the present invention.

DESCRIPTION OF THE PREFERRED EMBODIMENT

Illustrated in FIGS. 1–3 is a prefabricated fireplace 10 which comprises a chimney or stack 11, a firebox section 12, and a base 13. More specifically, the firebox section 12 is made of a firebrick or of a suitable refractory material. The firebox section 12 is formed with a suitable stack opening 15. Additionally, the firebox section 12 is formed with vertical firebrick side walls 16 and 17, and a vertical firebrick rear wall 18. The firebox section 12 also has a hearth opening 19 and a firebrick bottom or hearth 20. A sloping firebrick top wall 21 extends forwardly from the rear wall 18 to the stack opening 15. It is apparent that the firebox section may be made of steel or any other suitable material.

The firebox section 12 is formed with a throat 25 defined by a sloping top wall 26, a protrusion 27, and the sloping top wall 21. A concrete encasement 30 substantially encloses the sides of the firebox section 12, excepting the hearth 19 and the stack opening 15. A suitable damper 35 is disposed at the throat 25 and is supported by the protrusion 27 for pivotal movement.

The chimney or stack 11 is made of concrete and is integrally formed with the concrete encasement 30. It is formed with a flue 36. The flue 36 is in communication with the stack opening 15 of the firebox section 12. The concrete of the fireplace 10 is reinforced with longitudinally extending steel rods 40 and transverse tie rods 41 in a well-known manner.

The base 13 of the fireplace 10 is also formed of concrete and is integrally formed with the concrete encasement 30. In the exemplary embodiment, the base 13 is set back from the hearth face of the firebox section 12 to provide a recess 45 and an overhanging ledge 46.

At the time of installation of the fireplace 10, a house foundation 50 made of concrete may be in place. The recess 45 of the base 13 is shaped to conform to the configuration of the house foundation 50. However, the ledge 46 is disposed above and spaced from the house foundation 50.

According to the present invention, a fireplace foundation 60 of concrete is installed at the house site prior to the installation of the fireplace 10. In the lowermost concrete surface **13*a* of the base 13 of the fireplace 10 are embedded weld plates 65 and 66. The weld plates 65 and 66 are preferably channel-shaped or T-shaped and extend along the base 13 of the fireplace 10 in parallel, transversely-spaced relation and below concrete side walls 68 and 69, respectively, of the fireplace 10**.

Disposed in the concrete side walls 68 and 69, respectively, of the fireplace 10 and extending into the base 13 are reinforcing steel members, 71 and 70 which are attached to the weld plates 65 and 66, respectively.

In the uppermost concrete surface 60*a* of the fireplace foundation 60 are embedded weld plates 80 and 81. In the preferred embodiment, the weld plates 80 and 81 are channel-shaped or T-shaped. The weld plates 80 and 81 extend in parallel, transversely spaced relation. When the fireplace 10 is properly located relative to the fireplace foundation 60 for installation, the weld plates 80 and 81 will underlie and engage the weld plates 66 and 65, respectively. Depending from the bottom of the channel-shaped weld plates 80 and 81 are reinforcing rods 80*a* and 81*a*.

The house foundation 50 is formed with a ledge 50*a* on which rests in abutting relation end portions of the weld plates 80 and 81. The upper surface 60*a* of the fireplace foundation 60 may be above the ledge 50*a* of the house foundation 50.

After the fireplace 10 is properly located relative to the fireplace foundation 60 for installation and the weld plates 80 and 81 underlie the weld plates 66 and 65, respectively, the weld plates 80 and 66 are welded together and the weld plates 81 and 65 are welded together.

We claim:

1. The combination of a prefabricated fireplace and a fireplace foundation,

A. said prefabricated fireplace comprising:
  (a) a base with a lower surface, and
  (b) a weld plate fixed to the lower surface of said base; and B. said fireplace foundation comprising:
  (a) an upper surface, and
  (b) a weld plate fixed to said upper surface, said weld plate fixed to said base of said prefabricated fireplace being welded to said weld plate fixed to said fireplace foundation for installing said prefabricated fireplace on said fireplace foundation, C. said weld plate fixed to said base being a first base weld plate, said prefabricated fireplace further comprising a second base weld plate fixed to the lower surface of said base in spaced parallel relation to said first base weld plate, said weld plate fixed to said fireplace foundation being a first foundation weld plate, said fireplace foundation further comprising a second foundation weld plate fixed to the upper surface of said fireplace foundation in spaced parallel relation to said first foundation weld plate, said base weld plates being welded to said foundation weld plates, respectively, for installing said prefabricated fireplace on said fireplace foundation, D. said prefabricated fireplace comprising a firebox section integrally formed with said base and disposed above said base, said firebox section being formed with a first and second upright side wall, said first and second base weld plate being disposed below said first and second upright side wall, respectively, E. said first and second upright side wall extending along said base and said first and second base weld plate extending below said first and second side wall, respectively, F. said first and second foundation weld plate extending in the same direction as said first and second base weld plate, G. said prefabricated fireplace comprising an upright reinforcing member disposed in said first and second upright side wall, respectively, and through said base, said upright reinforcing members extending from said base weld plates, respectively.

2. The combination as claimed in claim 1 wherein a reinforcing member extends from each of said first and second foundation weld plate and are disposed in said second foundation.

3. A prefabricated fireplace comprising:
(a) a firebox section formed with a first and second side wall;
(b) a base disposed below said firebox section, said base having a lower surface;
(c) a first weld plate fixed to the lower surface of said base and extending along said base, said first weld plate being disposed below said first side wall;
(d) a second weld plate fixed to the lower surface of said base in spaced parallel relation to said first weld plate; said second weld plate being disposed below said second side wall; and
(e) a reinforcing member disposed in each of said first and second side wall members and in said base, said reinforcing members extending from said first and second weld plates, respectively.

4. A prefabricated fireplace as claimed in claim 3 wherein each of said weld plates are channel-shaped.

* * * * *